United States Patent [19]

Kozacka

[11] 4,001,749

[45] Jan. 4, 1977

[54] ELECTRIC FUSE FOR ELEVATED CIRCUIT VOLTAGES

[75] Inventor: Frederick J. Kozacka, South Hampton, N.H.

[73] Assignee: The Chase-Shawmut Company, Newburyport, Mass.

[22] Filed: Dec. 17, 1975

[21] Appl. No.: 641,665

[52] U.S. Cl. ..... 337/244; 337/241

[51] Int. Cl.[2] ..... H01H 85/30

[58] Field of Search ..... 337/158, 159, 161, 162, 337/186, 190, 241, 244, 290, 293

[56] References Cited

UNITED STATES PATENTS

| | | | |
|---|---|---|---|
| 2,417,268 | 3/1947 | Powell | 337/244 |
| 3,263,048 | 7/1966 | Hicks | 337/244 X |
| 3,304,389 | 2/1967 | Lindell | 337/241 X |
| 3,304,390 | 2/1967 | Lindell | 337/241 X |
| 3,832,665 | 8/1974 | Belcher | 337/244 |

*Primary Examiner*—J D Miller
*Assistant Examiner*—Fred E. Bell
*Attorney, Agent, or Firm*—Erwin Salzer

[57] ABSTRACT

A fuse for elevated circuit voltages is provided with first fusible element means having a relatively low resistance and wound substantially helically around a mandrel formed of insulating plates. The fuse is provided with a spring-biased blown fuse responsive device for indicating whether or not the fuse has blown, or for tripping a switching device with relatively movable contacts, e.g. a disconnect. The blown fuse responsive device is under the control of a second fusible element means which has a relatively high resistance. Said second fusible element means includes a plurality of spaced sections forming therebetween a voltage-responsive break-down spark gap. The mandrel for supporting the first fusible element has a perforation immediately adjacent the end thereof at which the blown fuse responsive device is arranged. Two contiguous sections of the second fusible element are spaced from each other and form a voltage responsive break-down spark gap.

When an arc takes the place of the first fusible element means the arc-voltage causes a break-down of the aforementioned spark gap. This initiates a current flow through the second fusible element means, resulting in its fusion at a predetermined point thereof. This, in turn, causes operation of the blown fuse responsive device.

The aforementioned mandrel performs functions in addition to supporting the first fusible element means. It forms the spark gap, defines its length with a very satisfactory degree of precision, and it receives the reaction of the spring forces biasing the blown fuse responsive device.

5 Claims, 4 Drawing Figures

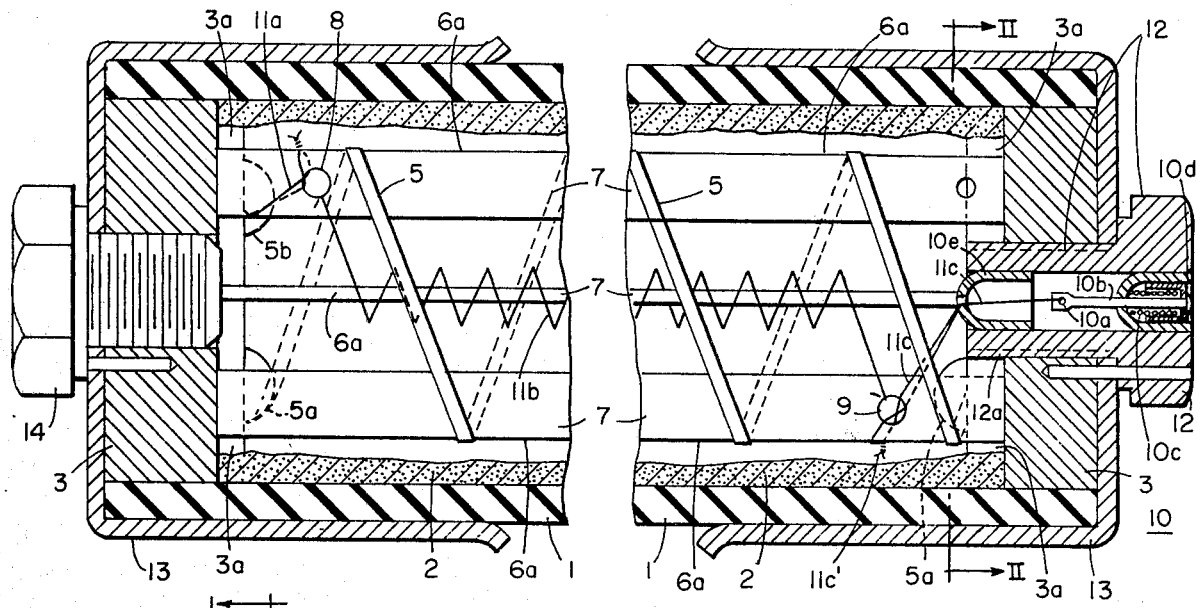
FIG. 1
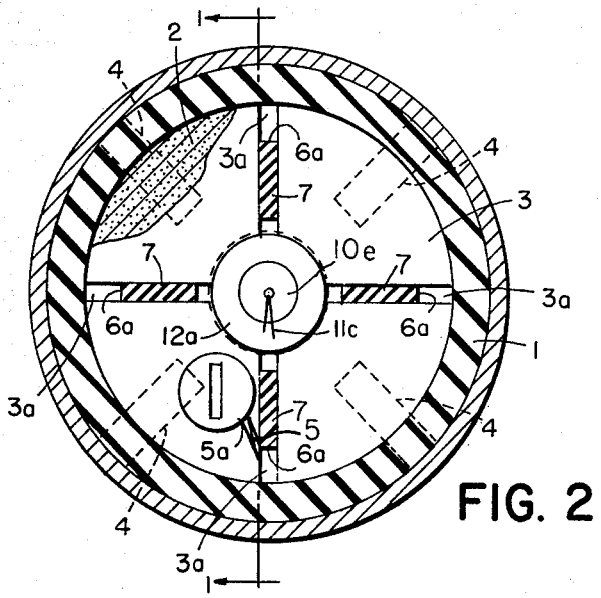
FIG. 2
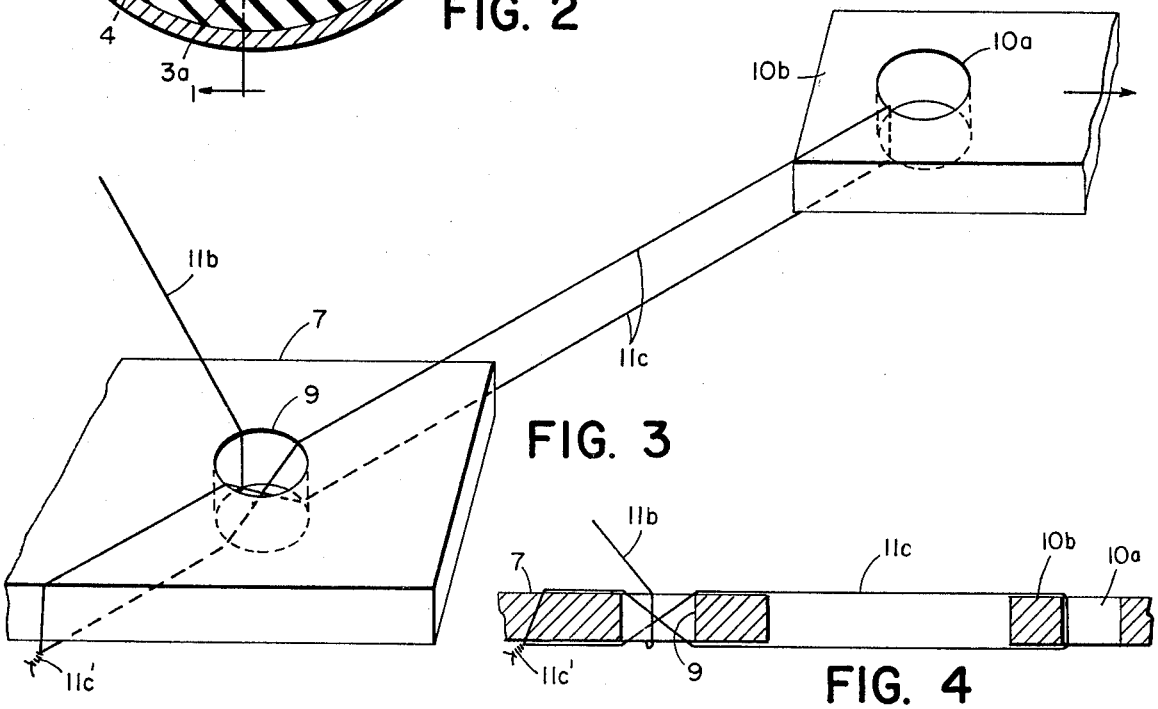
FIG. 3
FIG. 4

ELECTRIC FUSE FOR ELEVATED CIRCUIT VOLTAGES

BACKGROUND OF THE INVENTION

It is often necessary to provide electric fuses with means which are responsive to blowing thereof. Such means may be used either to indicate that the particular fuse has blown, or to trip an automatic switch or circuit breaker arranged in series with the fuse.

As a general rule the means responsive to blowing of a fuse include a spring-biased pin normally maintained in a first, or non-indicating position, and caused when the fuse blows by its spring bias to move to a second, or indicating position.

Fuses of the kind under consideration include two parallel-connected fusible element means namely a first low resistance fusible element means and a second high resistance fusible element means. Normally the first fusible element means carries virtually the entire load current and the second fusible element means is virtually non-current carrying. When the current path through the first fusible element means is interrupted by overload currents, or short-circuit currents, the second fusible element means becomes current-carrying. This causes fusion thereof in rapid sequence to the overcurrent-caused fusion of the first fusible element means. Fusion of the second fusible element means liberates blown fuse responsive means allowing the same to move from their above referred-to first position to their above referred-to second position.

In low-voltage fuses the second or high-resistance fusible element establishes a current path which is normally continuous, extending from one terminal element of the fuse to the other terminal element thereof. It is common practice in high voltage fuses to include a break-down spark gap in the current path of the second or high-resistance fusible element. As a result of the presence of that break-down spark gap the current path of the second or high-resistance fusible element is normally interrupted at the point where the break-down spark gap is located. When the current path of the first or low resistance fusible element is interrupted on occurrence of an overload current or short-circuit current, a voltage appears across the break-down gap which voltage is sufficiently high to cause its break-down. As a result of this break-down and consequent arcing across the gap, a continuous current path is now established by the intermediary of the second or high resistance fusible element means from one terminal element of the fuse to its other terminal element. This causes fusion of the second fusible element at some predetermined point thereof which, in turn, causes operation of the blown fuse responsive device of the fuse.

It will be understood that in the aforementioned type of fuses the second or high resistance fusible element is subdivided into sections by the presence of the aforementioned spark gap. While the entire length of the high resistance shunt across the first low resistance fusible element may rightly be referred-to as a second fusible element, fusion thereof occurs, as mentioned above, only at a predetermined point of it at which point the positioning of the blown fuse indicating means is controlled by the mechanical integrity, or the absence of the mechanical integrity, respectively, of the second fusible element.

The present invention refers more specifically to fuses for elevated circuit voltages wherein the first low resistance fusible element is substantially helically wound around a mandrel of electric insulating materials, and one of the principal objects of this invention is to use that mandrel for purposes other than as fusible element support, thus greatly reducing the cost of manufacture of the fuse.

Another object of the invention is to adapt the aforementioned mandrel to define with a satisfactory degree of precision the break-down spark gap whose electric break-down causes energization of the high resistance fusible element, and operation of the blown fuse responsive means.

Still another object of this invention is to provide a high-voltage fuse wherein the reaction to the spring forces biasing the blown fuse responsive means are positively transmitted to the insulating mandrel. These spring forces may be very considerable, particularly if the blown fuse responsive means are not merely intended as blown fuse indicators, but are supposed to overcome the relatively large latch friction of a high voltage disconnect, or like piece of equipment. In the absence of firm and rugged means for anchoring the spring that biases the blown fuse responsive means, the latter may move simply by conventional handling of the fuse to a position intermediate their non-blown fuse position and their blown fuse position.

A further object of the invention is to provide fuses for elevated circuit voltages which have plug terminal inserted into the ends of the tubular fuse casing of insulating material wherein energization of the high resistance fusible element is controlled by the break-down of one or more spark gaps serially arranged therein, and wherein the blown fuse responsive means lends itself to be, and actually is, arranged in coaxial relation to the plug terminals.

Further objects and advantages of the invention will become apparent as the following description proceeds, and the features of novelty which characterize the invention will be pointed out with particularity in the claims annexed to, and forming part of, this specification.

SUMMARY OF THE INVENTION

Fuses embodying this invention include a tubular casing of electric insulating material housing therein a granular arc-quenching filler. The casing is closed at its ends by a pair of terminal elements. The terminal elements are conductively interconnected by a first substantially helically wound fusible element means submersed in said filler. Fuses embodying this invention are further provided with a spring-biased blown fuse responsive device arranged immediately adjacent one of the aforementioned pair of terminal elements. The operationof the blown fuse responsive device is controlled by a second high resistance fusible element means submersed in said filler and shunting at least a portion of said first fusible element means. The second fusible element means is sectionalized. It includes at least two spaced sections forming a voltage responsive break-down spark gap therebetween. The first fusible element means is supported by a mandrel extending in a direction longitudinally of the casing. The mandrel has a perforation through which spaced sections of the second fusible element means are threaded at spaced points of said perforation so that the aforementioned spark gap is formed by said perforation in said mandrel.

BRIEF DESCRIPTION OF THE DRAWINGS

FIG. 1 is substantially a longitudinal section along I-I of FIG. 2 showing a fuse embodying this invention, FIG. 1 showing some parts in elevation rather than sectionalized, and FIG. 1 showing only the portions of the fuse including its terminal elements and the portions immediately adjacent the terminal elements, while deleting the intermediate portions of the fuse;

FIG. 2 is a section along II-II of FIG. 1;

FIG. 3 is an isometric diagrammatic view of a detail of the structure of FIGS. 1 and 2; and FIG. 4 is a longitudinal section of the detail shwon in FIG. 3.

DESCRIPTION OF PREFERRED EMBODIMENT

In the drawing numeral 1 has been applied to indicate a tubular casing of electric insulating material, e.g. a melamine-glass-cloth laminate, housing therein a pulverulent arc-quenching filler 2, preferably quartz sand. Filler 2 has been deleted in some portions of the drawing in order to expose to view other parts of the fuse structure. A pair of terminal plugs 3 is press-fitted into the ends of casing 1 and firmly held in position by steel pins 4 projecting radially through casing 1 into terminal plugs 3. Reference numeral 5 has been applied to indicate a first substantially helically wound low resistance fusible element means submersed in filler 2 conductively interconnecting terminal elements or terminal plugs 3. Fusible element means 5 is preferably a ribbon of silver having a plurality of points of reduced cross-sectional area (not shown). the current-carrying capacity of the structure shown may be increased by connecting several helically wound silver ribbons 5 in parallel. The ends of ribbon or ribbons 5 may be mechanically and electrically or conductively connected to the axially inner end surfaces of terminal plugs 3 by means of screws 5*a* and solder joints as shown in detail in U.S. Pat. No. 3,571,775 to F. J. Kozacka et al; 03/23/71 for HIGH VOLTAGE FUSE HAVING A PLURALITY OF HELICALLY WOUND RIBBON FUSE LINKS. Fusible element 5 is supported by a mandrel 6 of electric insulating material having radially outer edges 6*a* extending in a direction longitudinally of casing 1. Mandrel 6 is made-up of four plates 7 which are arranged at right angles. Two of plates 7 are provided with apertures of circular bores 8 and 9. Reference numeral 10 has been appllied to indicate generally a blown-fuse-responsive spring-biased device arranged immediately adjacent to, i.e. built into, one of terminal plugs 3. The circular bore 9 in one of plates 7 is arranged immediately adjacent to plug 3 into which device 10 is built, while the circular bore 8 is arranged in another of plates 7 immediately adjacent to the other of plugs 3. The fuse includes a high resistance fusible element means submersed in filler 2 and shunting at least a portion of fusible element 5. In the instant case the entire fusible element 5 is shunted by the aforementioned high reisitance fusible element means which is made up of three sections. The first section 11*a* extends from one of plugs 3 to circular aperture 8; the second section 11*b* extends from circular aperture 8 to circular aperture 9; and the third section 11*c* extends from circular aperture 9 to device 10. Section 11*a* is formed by a length of wire threaded through aperture 8. The ends of that length of wire remote from aperture 8 are conductively connected by means of a screw 5*b* to the axially inner end surface of plug 3 immediately adjacent to aperture 8. The second section 11*b* of the high resistance fusible element is formed by a resilient helically wound resistance wire which is in effect a tension spring. The ends of section 11*b* are substantially hook-shaped. One of these ends is hooked into aperture 8 and the other of these ends is hooked into aperture 9. The third section 11*c* is formed by a length of resistance wire threaded through a bore 10*a* in the flattened end of spring biased rod 10*b* of device 10 and also threaded through bore 9 in one of plates 7. The end of section 11*c* are twisted upon each other as indicated at 11*c*'.

The blown fuse responsive device 10 includes compression spring 10*c* biasing rod 10*b* and the latter is normally restrained by wire section 11*c* from moving under the action of spring 10*c* from left to right, as seen in FIG. 1 While one end of spring 10*c* rests against the end of rod 10*b* remote from aperture 10*a*, the other end of spring 10*c* rests against a cap 10*d*. Another cap 10*e* through a coaxial bore in which wire section 11*c* is threaded precludes entry of filler 2 into a chamber housing rod 10*b* and cap 10*d*. That chamber is formed by a hollow shaft 12*a* of a screw 12 by which one ferrule 13 is screwed against the axially outer end surface of one of plugs 3. The other ferrule 13 is screwed by a screw 14 against the axially outer end surface of the other of plugs 3.

A first spark gap is formed between sections 11*a* and 11*b* and a second spark gap is formed between sections 11*b* and 11*c*. Incident to blowing of the fuse an electric arc takes the place of low resistance fusible element 5. When the arc voltage is sufficiently high, both aforementioned spark gaps break down. This establishes a current path from screw 5*b* on one of plugs 3 through wire section 11*a*, across aperture 8 and through wire section 11*b* and across aperture 9 through wire section 11*c* and rod 10 to the other of plugs 3. As a result of the flow of current through that current path section 11*c* fuses, allowing compression spring 10*c* to move rod 10*b* from left to right, as seen in FIG. 1.

The breakdown voltage of spark gaps at 8 and 9 depends upon the diameter of these two apertures. Therefore the desired breakdown voltage of the spark gaps at 8 and 9 can readily be determined by the selection of the diameters of the spark gaps formed at apertures 8 and 9. Where the arc voltage generated incident to blowing of the fuse is relatively limited, the spark gap at 8 may be dispensed with, in which instance section 11*a* may be dispensed with and section 11*b* directly conductively connected by means of screw 5*b* to the plug 3 immediately adjacent thereto.

In order to fixedly position plates 7, plugs 3 are provided with groove means 3*a* at the axially inner end surfaces thereof. These groove means 3*a* receive the transverse relatively short edges of the elongated plate means 7. While the radially outer longitudinal edges 6*a* of plates 7 support fusible element 5, the radially inner edges of plates 7 are separted from each other (see FIG. 2) and bound a space wherein fusible element section 11*b* is arranged in coaxial relation to, but widely separated from, low resistance fusible element means 5. The aforementioned way of arranging wire section 11*b* is far better than winding the same around the radially outer edges 6*a* of plates 7 because it allows to maximize the insulating spacing between contiguous turns of fusible element means 5.

As long as the force of spring 10*c* is relatively moderate, affixing wire section 11*c* — which is the restraining wire for blown fuse responsive device 10 — to aperture 9 in one of plates 7 does not present any particular problem. The situation is quite different if spring 10*c* exerts a considerable force upon rod 10*b*. In that instance it is vitally important to maximize the friction of frictional forces between restraining wire section 11*c* and the plate 7 provided with perforation 9 in order to avoid any slight unintentional movement between pin 10*b* and plates 7 under the action of spring 10*c*. In order to positively prevent such movement wire section 11*c* is threaded to the perforation 10*a* in rod 10*b* so that two ends of wire section 11*c* extend beyond perforation or aperture 10*a*. Then one of these ends is threaded through aperture 9 from one side thereof to the other and the other of these ends is threaded through aperture 9 from said other to said one side thereof. As a result, both ends of wire section 11*c* cross each other inside aperture 9 and exit from aperture 9 at different sides of the plate 7 in which aperture 9 is provided. The ends of wire section 11*c* leaving aperture 9 on opposite sides of the plate 7 in which aperture 9 is provided are tied together, preferably by twisting, as indicated at 11*c*'.

When the spark gaps coextensive with apertures 8 and 9 break down, arcs are kindled between wire sections 11*a* and 11*b* and wire sections 11*b* and 11*c*. As a result, a current flows from one terminal plug 3 to the other terminal plug 3 by a current path that includes high resistance wire sections 11*a*, 11*b*, 11*c*, rod 10*b* and cap 10*d*. the portion of that current path designed to fuse before any other portion thereof reaches its fusing temperature is wire section 11*c*. When wire section 11*c* fuses, spring 10*c* propels rod 10*b* from left to right, as seen in FIG. 1.

I claim as my invention:

1. An electric fuse for elevated circuit voltages including a. tubular casing of electric insulating material housing therein a granular arc-quenching filler;

b. a pair terminal elements closing the ends of said casing;

c. a spring-biased blown fuse responsive device arranged immediately adjacent one of said pair of terminal elements;

d. first substantially helically wound low resistance fusible element means submersed in said filler conductively interconnecting said pair of terminal elements;

e. a second high resistance fusible element means submersed in said filler shunting at least a portion of said first fusible element means and arranged to control the operation of said blown fuse responsive device, said second fusible element means having a pair of spaced sections forming therebetween a voltage responsive breakdown spark gap;

f. a mandrel of electric insulating material having edges extending in a direction longitudinally of said casing and supporting said first fusible element means, said mandrel having a perforation, and each of said pair of spaced sections of said second fusible element means being threaded through said perforation in said mandrel at spaced points of said perforation so that said perforation in said mandrel forms said spark gap.

2. An electric fuse as specified in claim 1 wherein said second fusible element means includes a section formed by a looped restraining wire for said blown fuse responsive device, one end of said restraining wire being threaded through said perforation from one side to the other side thereof, the other end of said restraining wire being threaded through said perforation from said other side to said one side thereof, and said one end and said other end of said restraining wire being twisted together at a point outside said perforation.

3. An electric fuse for elevated circuit voltages including a. a tubular casing of electric insulating material housing therein a pulverulent arc-quenching filler;

b. a pair of terminal plugs inserted into the ends of said casing and closing said casing, each of said pair of terminal plugs having groove means in the axially inner end surface thereof;

c. a spring-biased blown fuse responsive device arranged substantially at the center of one of said pair of terminal plugs;

d. a first substantially helically wound low resistance fusible element means submersed in said filler conductively interconnecting said pair of terminal plugs;

e. a second substantially helically wound high resistance fusible element means inside of and substantially in coaxial relation to said first fusible element means conductively interconnecting said pair of terminal plugs and arranged to control said blown fuse responsive device, said second fusible element means including a plurality of spaced sections forming at least one voltage responsive gap therebetween;

f. elongated plate means of electric insulating material inside said casing having transverse axially outer edges engaging said groove means in said axially inner end surfaces of each of said pair of terminal plugs and having radially outer longitudinal edges engaged by said first fusible element means, said plate means being provided with at least one substantially transverse aperture near the end thereof adjacent said blown fuse responsive device; and g. said one gap in said second fusible element means being coextensive with said aperture in said plate means.

4. An electric fuse as specified in claim 3 wherein a. said groove means in said axially inner end surfaces of each of said pair of terminal plugs intersect at right angles;

b. said elongated plate means include four separate plates having radially inner longitudinal edges being spaced from each other and bounding a space receiving a helically wound section of said second fusible element means;

c. said aperture in said plate means is circular and has a center situated between the radially outer and the radially inner edges of one of said four plates; and wherein said helically wound section of said second fusible element means has spring-like resiliency and has a substantially hookshaped end engaging said aperture.

5. An electric fuse as specified in claim 3 wherein a. said blown fuse responsive device includes a spring-biased rod having a flattened and perforated axially inner end; and wherein b. one of said sections of said second fusible element means is threaded through said flattened and perforated end of said rod and also through said aperture in said plate means, one end of said one of said sections of said second fusible element means entering said plate means on one side and leaving said plate means on the opposite side thereof, and the other end of said one of said sections of said second fusible element means entering said plate means on said opposite side and leaving said plate means on said one side thereof, and said one end and said other end of said one of said sections of said second fusible element means being tied together at a point outside said aperture of said plate means.

* * * * *